US008534767B2

(12) United States Patent
Hall et al.

(10) Patent No.: US 8,534,767 B2
(45) Date of Patent: Sep. 17, 2013

(54) MANUALLY ROTATABLE TOOL

(76) Inventors: David R. Hall, Provo, UT (US); Ronald B. Crockett, Payson, UT (US); Gary Peterson, Provo, UT (US); Jeff Jepson, Spanish Fork, UT (US)

( * ) Notice: Subject to any disclaimer, the term of this patent is extended or adjusted under 35 U.S.C. 154(b) by 180 days.

(21) Appl. No.: 13/182,421

(22) Filed: Jul. 13, 2011

(65) Prior Publication Data

US 2011/0266861 A1 Nov. 3, 2011

Related U.S. Application Data

(63) Continuation of application No. 12/428,531, filed on Apr. 23, 2009, which is a continuation-in-part of application No. 12/177,556, filed on Jul. 22, 2008, now Pat. No. 7,635,168, which is a continuation-in-part of application No. 12/135,595, filed on Jun. 9, 2008, now Pat. No. 7,946,656, which is a continuation-in-part of application No. 12/112,743, filed on Apr. 30, 2008, (Continued)

(51) Int. Cl.
*E21C 35/19* (2006.01)

(52) U.S. Cl.
USPC ..... 299/113; 299/111

(58) Field of Classification Search
USPC ..... 299/105, 106, 107, 111, 113, 103, 299/104
See application file for complete search history.

(56) References Cited

U.S. PATENT DOCUMENTS 2,004,315 A 6/1935 Fean
2,124,438 A 7/1938 Struk (Continued)

FOREIGN PATENT DOCUMENTS

DE 3500261 7/1986
DE 3818213 11/1989

(Continued)

*Primary Examiner* — John Kreck
(74) *Attorney, Agent, or Firm* — Philip W. Townsend, III

(57) ABSTRACT

In one aspect of the present invention, a tool assembly comprises a rotary portion and a stationary portion. The rotary portion comprises a bolster bonded to a diamond symmetric, substantially conically shaped tip. The stationary portion comprises a block mounted to a driving mechanism. A compressible element is disposed intermediate and in mechanical contact with both the rotary and stationary portions. The compressible element is compressed sufficiently to restrict free rotation during a degradation operation.

15 Claims, 13 Drawing Sheets

Related U.S. Application Data now Pat. No. 8,029,068, which is a continuation-in-part of application No. 12/051,738, filed on Mar. 19, 2008, now Pat. No. 7,669,674, which is a continuation-in-part of application No. 12/051,689, filed on Mar. 19, 2008, now Pat. No. 7,963,617, which is a continuation of application No. 12/051,586, filed on Mar. 19, 2008, now Pat. No. 8,007,050, which is a continuation-in-part of application No. 12/021,051, filed on Mar. 19, 2008, now Pat. No. 8,123,302, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, application No. 13/182,421, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 3,254,392 | A | | 6/1966 | Novkov |
| 3,746,396 | A | | 7/1973 | Radd |
| 3,807,804 | A | | 4/1974 | Kniff |
| 3,830,321 | A | | 8/1974 | McKenry |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels |
| 4,199,035 | A | | 4/1980 | Thompson |
| 4,201,421 | A | | 5/1980 | Den Besten |
| 4,277,106 | A | | 7/1981 | Sahley |
| 4,316,636 | A | | 2/1982 | Taylor |
| 4,439,250 | A | | 3/1984 | Acharya |
| 4,465,221 | A | | 8/1984 | Schmidt |
| 4,484,644 | A | | 11/1984 | Cook |
| 4,489,986 | A | | 12/1984 | Dziak |
| 4,678,237 | A | | 7/1987 | Collin |
| 4,682,987 | A | | 7/1987 | Brady |
| 4,688,856 | A | | 8/1987 | Elfgen |
| 4,725,098 | A | | 2/1988 | Beach |
| 4,729,603 | A | | 3/1988 | Elfgen |
| 4,765,686 | A | | 8/1988 | Adams |
| 4,765,687 | A | | 8/1988 | Parrott |
| 4,776,862 | A | | 10/1988 | Wiand |
| 4,880,154 | A | | 11/1989 | Tank |
| 4,932,723 | A | | 6/1990 | Mills |
| 4,940,288 | A | | 7/1990 | Stiffler |
| 4,944,559 | A | | 7/1990 | Sionnet |
| 4,951,762 | A | | 8/1990 | Lundell |
| 5,007,685 | A | | 4/1991 | Beach |
| 5,011,515 | A | | 4/1991 | Frushour |
| 5,106,166 | A | * | 4/1992 | O'Neill ..... 299/104 |
| 5,112,165 | A | | 5/1992 | Hedlund |
| 5,141,289 | A | | 8/1992 | Stiffler |
| 5,154,245 | A | | 10/1992 | Waldenstrom |
| 5,161,627 | A | * | 11/1992 | Burkett ..... 299/111 |
| 5,186,892 | A | | 2/1993 | Pope |
| 5,251,964 | A | | 10/1993 | Ojanen |
| 5,261,499 | A | | 11/1993 | Grubb |
| 5,332,348 | A | | 7/1994 | Lemelson |
| 5,417,475 | A | | 5/1995 | Graham |
| 5,447,208 | A | | 9/1995 | Lund |
| 5,535,839 | A | | 7/1996 | Brady |
| 5,542,993 | A | | 8/1996 | Rabinkin |
| 5,653,300 | A | | 8/1997 | Lund |
| 5,738,698 | A | | 4/1998 | Kapoor |
| 5,823,632 | A | | 10/1998 | Burkett |
| 5,837,071 | A | | 11/1998 | Andersson |
| 5,845,547 | A | | 12/1998 | Sollami |
| 5,875,862 | A | | 3/1999 | Jurewicz |
| 5,934,542 | A | | 8/1999 | Nakamura |
| 5,935,718 | A | | 8/1999 | Demo |
| 5,944,129 | A | | 8/1999 | Jensen |
| 5,967,250 | A | | 10/1999 | Lund |
| 5,992,405 | A | | 11/1999 | Sollami |
| 6,006,846 | A | | 12/1999 | Tibbitts |
| 6,019,434 | A | | 2/2000 | Emmerich |
| 6,044,920 | A | | 4/2000 | Massa |
| 6,051,079 | A | | 4/2000 | Andersson |
| 6,056,911 | A | | 5/2000 | Griffin |
| 6,065,552 | A | | 5/2000 | Scott |
| 6,099,081 | A | * | 8/2000 | Warren et al. ..... 299/104 |
| 6,113,195 | A | | 9/2000 | Mercier |
| 6,170,917 | B1 | | 1/2001 | Heinrich |
| 6,193,770 | B1 | | 2/2001 | Sung |
| 6,196,636 | B1 | | 3/2001 | Mills |
| 6,196,910 | B1 | | 3/2001 | Johnson |
| 6,199,956 | B1 | | 3/2001 | Kammerer |
| 6,216,805 | B1 | | 4/2001 | Lays |
| 6,270,165 | B1 | | 8/2001 | Peay |
| 6,341,823 | B1 | | 1/2002 | Sollami |
| 6,354,771 | B1 | | 3/2002 | Bauschulte |
| 6,364,420 | B1 | | 4/2002 | Sollami |
| 6,371,567 | B1 | | 4/2002 | Sollami |
| 6,375,272 | B1 | | 4/2002 | Ojanen |
| 6,419,278 | B1 | | 7/2002 | Cunningham |
| 6,478,383 | B1 | | 11/2002 | Ojanen |
| 6,499,547 | B2 | | 12/2002 | Scott |
| 6,517,902 | B2 | | 2/2003 | Drake |
| 6,585,326 | B2 | | 7/2003 | Sollami |
| 6,672,406 | B2 | | 1/2004 | Beuershausen |
| 6,685,273 | B1 | | 2/2004 | Sollami |
| 6,692,083 | B2 | | 2/2004 | Latham |
| 6,709,065 | B2 | | 3/2004 | Peay |
| 6,719,074 | B2 | | 4/2004 | Tsuda |
| 6,733,087 | B2 | | 5/2004 | Hall |
| 6,739,327 | B2 | | 5/2004 | Sollami |
| 6,758,530 | B2 | | 7/2004 | Sollami |
| 6,786,557 | B2 | | 9/2004 | Montgomery, Jr. |
| 6,824,225 | B2 | | 11/2004 | Stiffler |
| 6,851,758 | B2 | | 2/2005 | Beach |
| 6,854,810 | B2 | | 2/2005 | Montgomery, Jr. |
| 6,861,137 | B2 | | 3/2005 | Griffin |

| | | | | |
|---|---|---|---|---|
| 6,889,890 | B2 | 5/2005 | Yamazaki | |
| 6,966,611 | B1 | 11/2005 | Sollami | |
| 6,994,404 | B1 | 2/2006 | Sollami | |
| 7,204,560 | B2 | 4/2007 | Mercier | |
| 2002/0175555 | A1 | 11/2002 | Mercier | |
| 2003/0015907 | A1* | 1/2003 | Sollami | 299/104 |
| 2003/0141350 | A1 | 7/2003 | Noro | |
| 2003/0209366 | A1 | 11/2003 | McAlvain | |
| 2003/0234280 | A1 | 12/2003 | Cadden | |
| 2004/0026983 | A1 | 2/2004 | McAlvain | |
| 2004/0065484 | A1 | 4/2004 | McAlvain | |
| 2005/0159840 | A1 | 7/2005 | Lin | |
| 2005/0173966 | A1 | 8/2005 | Mouthaan | |
| 2006/0237236 | A1 | 10/2006 | Sreshta | |
| 2008/0030065 | A1* | 2/2008 | Frear | 299/104 |

FOREIGN PATENT DOCUMENTS

| | | |
|---|---|---|
| DE | 10163717 | 5/2003 |
| GB | 2004315 | 3/1979 |
| GB | 2037223 | 11/1979 |

* cited by examiner

MANUALLY ROTATABLE TOOL

CROSS REFERENCE TO RELATED APPLICATIONS

This application is a continuation of U.S. patent application Ser. No. 12/428,531, filed Apr. 23, 2009, which is a continuation-in-part of U.S. patent application Ser. No. 12/177,556, filed Jul. 22, 2008, now U.S. Pat. No. 7,635,168 which is a continuation-in-part of U.S. patent Ser. No. 12/135,595, filed Jun. 9, 2008, now U.S. Pat. No. 7,946,656 which is a continuation-in-part of U.S. patent Ser. No. 12/112,743, filed Apr. 30, 2008, now U.S. Pat. No. 8,029,068 which is a continuation-in-part of U.S. patent application Ser. No. 12/051,738, filed Mar. 19, 2008, now U.S. Pat. No. 7,669,674 which is a continuation-in-part of U.S. patent application Ser. No. 12/051,689, filed Mar. 19, 2008, now U.S. Pat. No. 7,963,617 which is a continuation of U.S. patent application Ser. No. 12/051,586, filed Mar. 19, 2008, now U.S. Pat. No. 8,007,050 which is a continuation-in-part of U.S. patent application Ser. No. 12/021,051, filed Mar. 19, 2008, now U.S. Pat. No. 8,123,302 which is a continuation-in-part of U.S. patent application Ser. No. 12/021,019, filed Jan. 28, 2008, which was a continuation-in-part of U.S. patent application Ser. No. 11/971,965, filed Jan. 10, 2008, now U.S. Pat. No. 7,648,210 which is a continuation of U.S. patent application Ser. No. 11/947,644, filed Nov. 29, 2007, now U.S. Pat. No. 8,007,051 which was a continuation-in-part of U.S. patent application Ser. No. 11/844,586, filed Aug. 24, 2007, now U.S. Pat. No. 7,600,823. U.S. patent application Ser. No. 11/844,586 is a continuation-in-part of U.S. patent application Ser. No. 11/829,761, filed Jul. 27, 2007, now U.S. Pat. No. 7,722,127. U.S. patent application Ser. No. 11/829,761 is a continuation-in-part of U.S. patent application Ser. No. 11/773,271, filed Jul. 3, 2007, now U.S. Pat. No. 7,997,661. U.S. patent application Ser. No. 11/773,271 is a continuation-in-part of U.S. patent application Ser. No. 11/766,903, filed Jun. 22, 2007. U.S. patent application Ser. No. 11/766,903 is a continuation of U.S. patent application Ser. No. 11/766,865, filed Jun. 22, 2007, now abandoned. U.S. patent application Ser. No. 11/766,865 is a continuation-in-part of U.S. patent application Ser. No. 11/742,304, filed Apr. 30, 2007, now U.S. Pat. No. 7,475,948. U.S. patent application Ser. No. 11/742,304 is a continuation of U.S. patent application Ser. No. 11/742,261, filed Apr. 30, 2007, now U.S. Pat. No. 7,469,971. U.S. patent application Ser. No. 11/742,261 is a continuation-in-part of U.S. patent application Ser. No. 11/464,008, filed Aug. 11, 2006, now U.S. Pat. No. 7,338,135. U.S. patent application Ser. No. 11/464,008 is a continuation-in-part of U.S. patent application Ser. No. 11/463,998, filed Aug. 11, 2006, now U.S. Pat. No. 7,384,105. U.S. patent application Ser. No. 11/463,998 is a continuation-in-part of U.S. patent application Ser. No. 11/463,990, filed Aug. 11, 2006, now U.S. Pat. No. 7,320,505. U.S. patent application Ser. No. 11/463,990 is a continuation-in-part of U.S. patent application Ser. No. 11/463,975, filed Aug. 11, 2006, now U.S. Pat. No. 7,445,294. U.S. patent application Ser. No. 11/463,975 is a continuation-in-part of U.S. patent application Ser. No. 11/463,962, filed Aug. 11, 2006, now U.S. Pat. No. 7,413,256. The present application is also a continuation-in-part of U.S. patent application Ser. No. 11/695,672, filed Apr. 3, 2007, now U.S. Pat. No. 7,396,086. U.S. patent application Ser. No. 11/695,672 is a continuation-in-part of U.S. patent application Ser. No. 11/686,831, filed Mar. 15, 2007, now U.S. Pat. No. 7,568,770. All of these applications are herein incorporated by reference for all that they contain.

BACKGROUND OF THE INVENTION

Formation degradation, such as drilling to form a well bore in the earth, pavement milling, mining, and/or excavating, may be performed using degradation assemblies. In normal use, these assemblies and auxiliary equipment are subjected to high impact, heat, abrasion, and other environmental factors that wear their mechanical components. Many efforts have been made to improve the service life of these assemblies. In some cases it is believed that the free rotation of the impact tip of the degradation assembly aides in lengthening the life of the degradation assembly by promoting even wear of the assembly.

U.S. Pat. No. 5,261,499 to Grubb, which is herein incorporated by reference for all that it contains, discloses a two-piece rotatable cutting bit which comprises a shank and a nose. The shank has an axially forwardly projecting protrusion which carries a resilient spring clip. The protrusion and spring clip are received within a recess in the nose to rotatable attach the nose to the shank.

U.S. patent application Ser. No. 12/177,556 to Hall, et al., which is herein incorporated by reference for all that it contains discloses, a degradation assembly comprises a shank with a forward end and a rearward end, the rearward end being adapted for attachment to a driving mechanism, with a shield rotatably attached to the forward end of the shank. The shield comprises an underside adapted for rotatable attachment to the shank and an impact tip disposed on an end opposing the underside. A seal is disposed intermediate the shield and the shank.

BRIEF SUMMARY OF THE INVENTION

In one aspect of the present invention, a tool assembly comprises a rotary portion and a stationary portion. The rotary portion comprises a bolster bonded to a diamond, symmetric, substantially conically shaped tip. The stationary portion comprises a block mounted to a driving mechanism. A compressible element is disposed intermediate and in mechanical contact with both the rotary and stationary portions. The compressible element is compressed sufficiently to restrict free rotation during a degradation operation. In some embodiments, the compressible element is compressed sufficiently enough to prevent free rotation. The tool assembly may be a degradation assembly.

In some embodiments, the compressible element comprises an o-ring under 20%-40% compression. The o-ring may also comprise a hardness of 70-90 durometers. The compression element may also act as a seal that retains lubricant within the assembly. The compression element may comprise any of the following: at least one rubber ball, a compression spring, a set screw, a non-round spring clip, a spring clip with at least one flat surface, a press fit pin, or any combination thereof. A first rubber compressible element may be disposed on the stationary portion and be in contact with a second rubber compressible element disposed on the rotary portion.

In some embodiments, the rotary portion of the assembly may comprise a puller attachment and/or a wrench flat. The rotary portion may also comprise a shield, such that a recess of the shield is rotatably connected to a first end of the stationary portion. The bolster may also wrap around a portion of the stationary portion.

In some embodiments, the compressible element may comprise a metallic material. The compressible element may be part of a metal seal, which is tight enough to prevent restrict or prevent free rotation.

In another aspect of the present invention the assembly may comprise a holder. The holder may be part of either the stationary or the rotary portion of the assembly. The holder may comprise at least on longitudinal slot.

In one aspect of the present invention, a degradation assembly comprises a bolster intermediate a shank and a symmetric, substantially conical shaped tip. The tip comprises a substrate bonded to a diamond material. The diamond comprises an apex coaxial with the tip, and the diamond being over 0.100 inches thick along the central axis of the tip. The shank is inserted into a holder attached to a driving mechanism. The assembly comprises a mechanical indexing arrangement, wherein the tip comprises a definite number of azimuthal positions determined by the mechanical indexing arrangement, each position orienting a different azimuth of the tip such that the different azimuth impacts first during an operation.

In some embodiments, the shank comprises substantially symmetric longitudinal flat surfaces. The shank may axially comprise a hexagonal shape, a star shape, or any other axially symmetric shapes. The shank may comprise and o-ring, a catch, a spring clip, or any combination thereof. The tip may be rotationally isolated from the shank.

In some embodiments, the bolster may comprise a puller attachment. The bolster may also be in communication with the driving mechanism through a press fit pin.

In some embodiments, the assembly may comprise a holder. The holder may be indexible, and the holder may comprise a substantially axially symmetric geometry. The holder may be in communication with the shank through a thread form. The holder may also comprise a spring loaded catch or a racketed cam.

In another aspect of the present invention, a method of utilizing a degradation assembly comprises, providing an degradation assembly comprising a bolster intermediate a shank and a tip, the tip comprising a substrate bonded to a diamond material comprising a symmetric, substantially conical shape, the diamond comprising an apex coaxial with the tip, and the diamond being over 0.100 inches thick along the central axis of the tip. Then an operator actuates the driving mechanism for a first period of time. Next, an operator rotates the degradation assembly along its central axis to another indexed azimuth. An operator then actuates the driving mechanism for a second period of time.

DETAILED DESCRIPTION OF THE INVENTION AND THE PREFERRED EMBODIMENT

Figure 1:
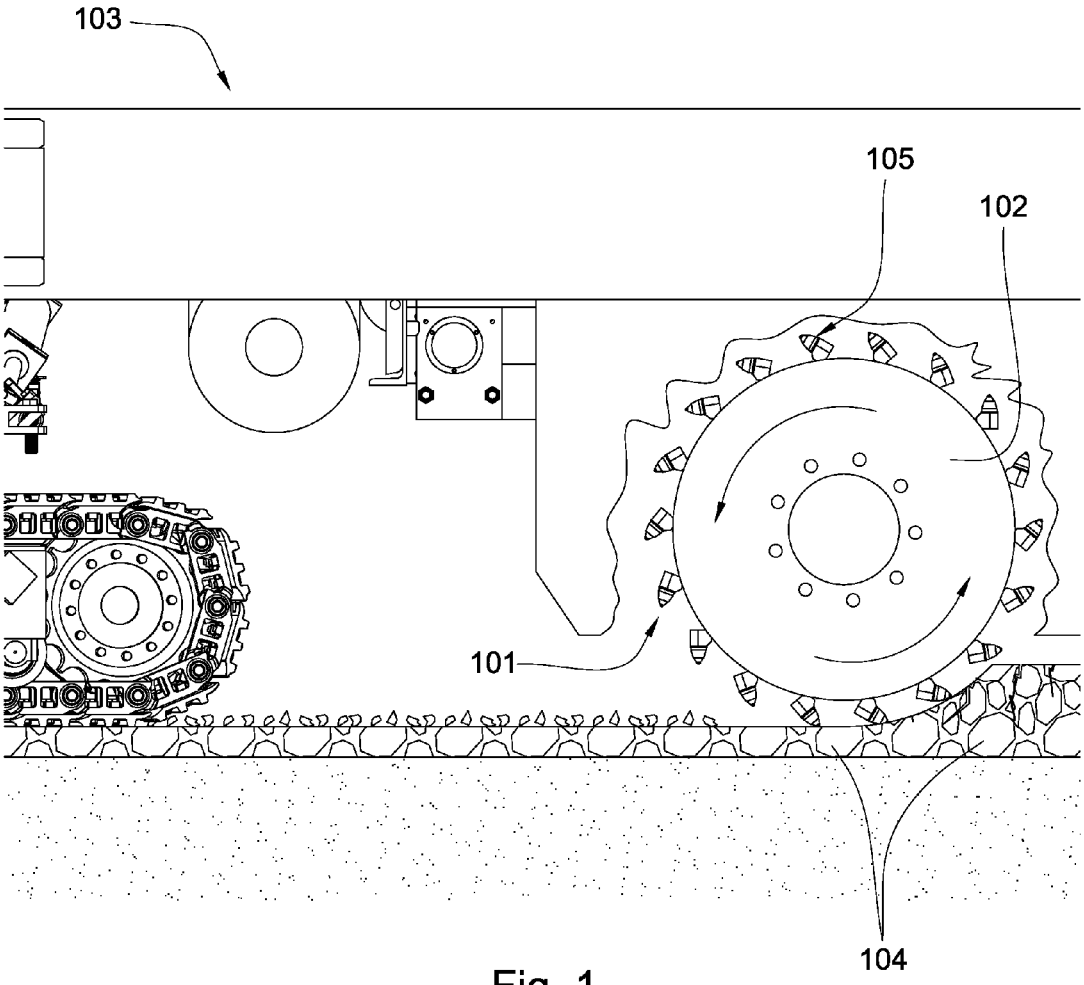
FIG. 1 is a cross-sectional diagram of an embodiment of a pavement milling machine.

FIG. 1 is a cross-sectional diagram that shows a plurality of degradation assemblies 101 attached to a driving mechanism 102, such as a rotatable drum attached to the underside of a pavement milling machine 103. The milling machine 103 may be an asphalt planer used to degrade man-made formations such as pavement 104 prior to placement of a new layer of pavement. The degradation assemblies 101 may be attached to the drum 102, bringing the degradation assemblies 101 into engagement with the formation 104. The degradation assembly 101 may be disposed within a block 105 welded or bolted to the drum attached to the driving mechanism 102. A holder may be disposed intermediate the degradation assembly 101 and the block 105. The block 105 may hold the degradation assembly 101 at an angle offset from the direction of rotation, such that the degradation assembly engages the formation 104 at a preferential angle. While an embodiment of a pavement milling machine 103 was used in the above example, it should be understood that degradation assemblies disclosed herein have a variety of uses and implementations that may not be specifically discussed within this disclosure.

Figure 2A:
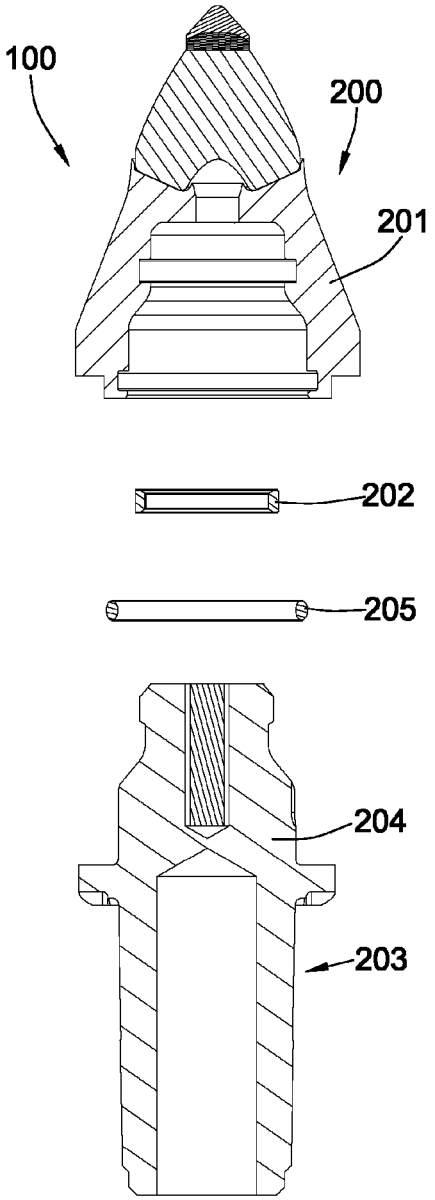
FIG. 2*a* is a cross-sectional and exploded diagram of an embodiment of a degradation assembly.

FIG. 2*a* is a cross sectional exploded diagram of an embodiment of a degradation assembly 101. In this embodiment the degradation assembly 101 comprises a rotary portion 200 in the form of a shield 201 and a stationary portion 203 in the form of a shank 204. A conical diamond tip 206 may be bonded to the shield 201. A compression element 208 in the form of an o-ring 205 may be adapted to be disposed intermediate the shield 201 and the shank 204. A spring clip 202 may also be adapted to be disposed intermediate the shield 201 and the shank 204. The o-ring may function as a grease barrier by maintaining grease intermediate the shield 201 and the shank 204.

Figure 2B:
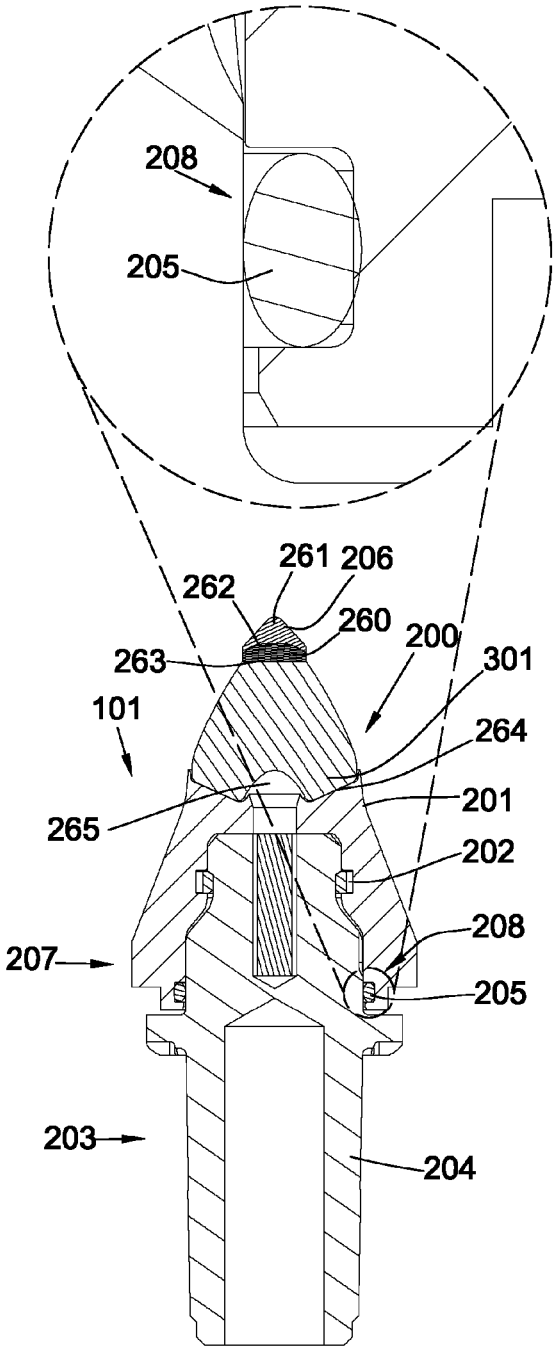
FIG. 2*b* is a cross-sectional diagram of another embodiment of a degradation assembly.

The embodiment depicted in FIG. 2*b* discloses a 20%-40% compressed o-ring 205. The o-ring 205 may be under enough compression that it reduces the cross sectional thickness of the o-ring by 20%-40%. The space between the shield 201 and shank 204 on the o-ring 205 may be small enough to put the o-ring in such a compressed state. It is believed that an o-ring compressed by 20%-40% by the inner surface of the shield and outer surface of the shank may provide enough friction to prevent free rotation of the rotary portion of the assembly 101 during degradation operations. The o-ring 205 may comprise a hardness of 70-90 durometers. The hardness of the o-ring 205 may influence the friction created between the o-ring 205 and the assembly and may also influence the durability and life of the o-ring 205. The o-ring may also function as a seal to retain a lubricant intermediate the shield and the shank. In this embodiment the assembly 101 may be used in degradation operations until the tip 206 begins to show uneven wear or for a predetermined time period. The assembly may then be manually rotated such that a new azimuth of the tip is oriented to engage the formation first. A wrench flat 207 may be disposed on the rotary portion 200 of the assembly 101 to allow the rotary portion to be turned by a wrench.

The rotary portion 200 comprises a tip 206 comprising a cemented metal carbide substrate 260 and a volume of sintered polycrystalline diamond 261 forming a substantially conical geometry with a rounded apex. The diamond 261 is preferably 0.100 to 0.250 inches thick from the apex to the interface between the substrate 260 and diamond 261 through its central axis. The substrate 260 comprises a relatively short thickness, preferably less than the mentioned thickness of the diamond 261. A short substrate 260 as identified may reduce the potential bending moments experienced by the substrate 260 during operation and therefore reduce the stress on the interface 262 between the substrate 260 and diamond 261 as well as the braze joint 263 bonding the substrate 260 to the rotary portion 200 of the assembly. Preferably, the substrate 260 is brazed to cemented metal bolster 301 affixed to the shield 201. The shank 204, bolster 301, and substrate 260 are preferably share a common central axis.

The bolster 301 is preferably wider at its base than the largest diameter of the substrate 260. However, preferably at their braze joint 263, the surface of the substrate 260 is slightly larger than the surface of the bolster. This may allow the substrate 260 to overhang slightly. The overhang may be small enough that it is not visible after brazing because braze material may extrude out filling the gap formed by the overhang. While an overhang as small as described may seem insignificant, improvement in field performance is contributed, in part, to it and is believed to further reduce stresses at the braze joint 263.

Preferably, the bolster 301 tapers from the interface with the substrate 260 to a second interface with a steel portion of the shield 201. At this interface, the braze joint 263 is relieved at the center with a small cavity 265 formed in the bolster 301. Also the thickness of the braze increases closer to the periphery of the braze joint, which is believed to help absorb impact loads during operation. Also, the steel curves around the corners of the bolster 301 at the second interface 264 to reduce stress risers.

The bolster's 301 shape tapers from the first interface 263 to the second interface 264 with a slightly convex form. The largest cross sectional thickness of the bolster 301 is critical because this thickness must be large enough to protect the steel beneath it as well as spread the formation fragment apart for effective cutting.

The described bolster 301 and tip 206 combination have proven very successful in the field. Many of the features described herein are critical for a long lasting degradation assembly 101. In the prior art, the weakest part of the degradation assembly 101 is generally the impact tip 206, which fail first. The prior art attempts to improve the life of these weaker tips by rotating the tips 206 through a bearing usually located between the inner surface of a holder bore and the outer surface of a shank 204. This rotation allows different azimuths of the tip 206 to engage the formation at each impact, effectively distributing wear and impact damage around the entire circumference of the tip 206. In the present invention, however, the combination of the tip 206 and bolster 301 is currently the most durable portion of the degradation assembly 101. In fact, it is so durable, that at present the applicants have not been able to create a bearing capable of outlasting this combination. In most cases, the bearing will fail before the tip 206 or bolster 301 receives enough wear or damage sufficient to replace them. At present, the tip 206 and bolster 301 combination is outlasting many of the commercially sold milling teeth by at least a factor of ten.

The advantage of the rotary portion 200 with a bolster 301 and tip 206 that is substantially prevented from rotating during operation as described is an extended life of the overall degradation assembly 101. Rotating the rotary portion manually at predetermined times, or as desired, allows the wear to be distributed around the tip 206 and bolster 301 as well. The assemblies' longer life benefits operators by reducing down time to replace worn assemblies and reducing replace part inventories.

Figure 3A:
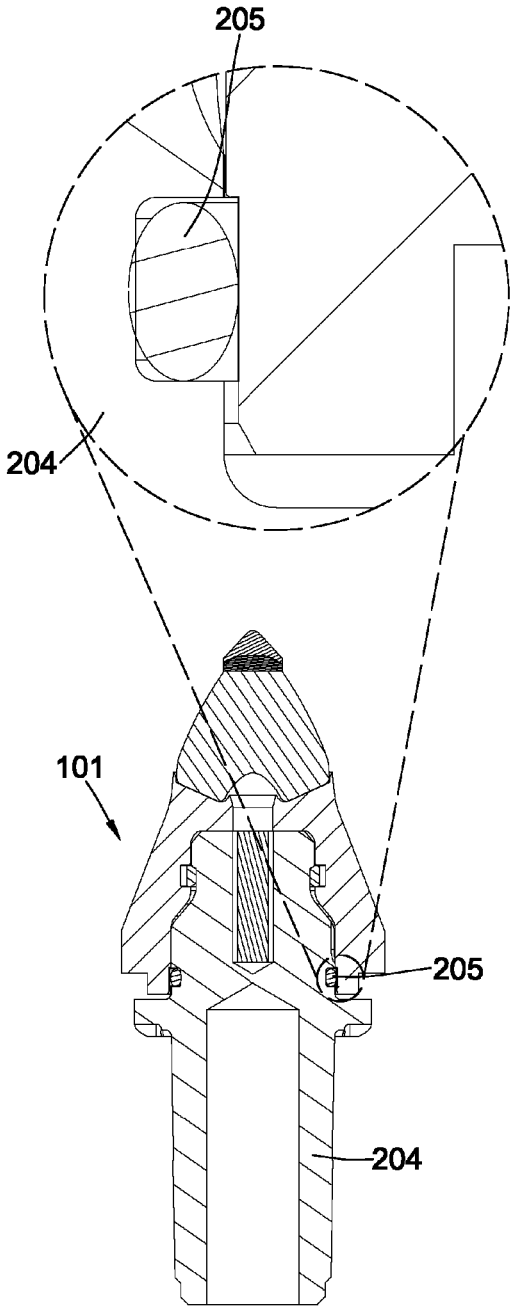
FIG. 3*a* is a cross-sectional diagram of another embodiment of a degradation assembly.
Figure 3B:
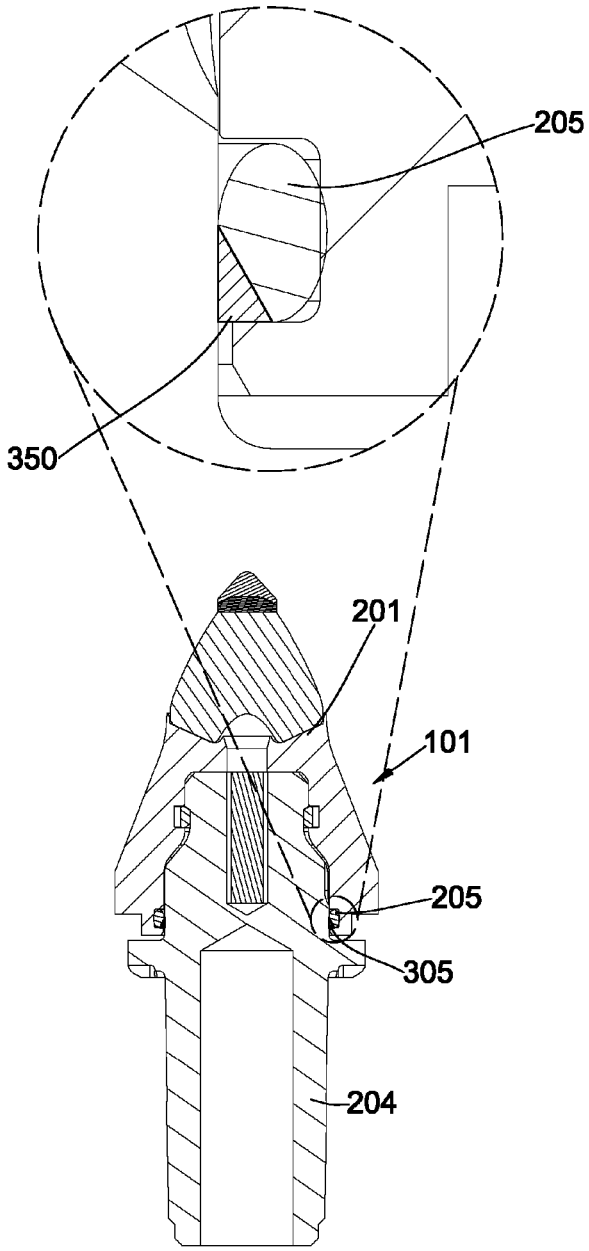
FIG. 3*b* is a cross-sectional diagram of another embodiment of a degradation assembly.

FIG. 3*a* is a cross sectional diagram depicting o-ring 205 disposed within a recess formed in the shank 204. The o-ring may still be under enough compression to substantially prevent the rotary portion's rotation. FIG. 3*b* discloses a back up 350 also disposed within the groove. The back up 350 may comprise a metal ring with at least one substantially slanted surface. The back up 350 may be placed intermediate the o-ring 205 and the shank 204. The back up 350 may aid in compressing the o-ring as well as protect it during assembly.

Figure 4A:
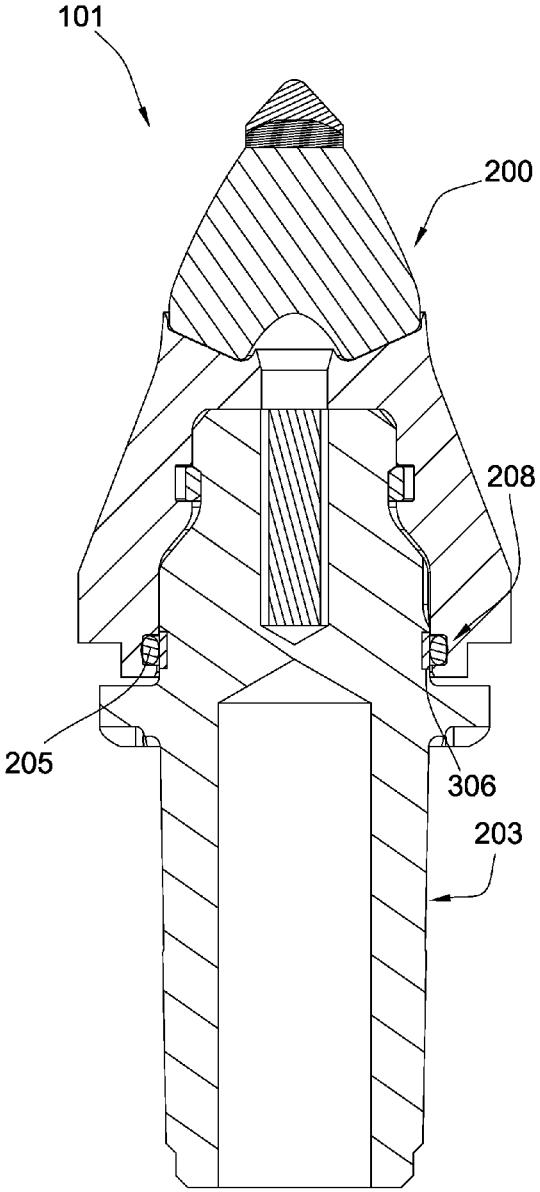
FIG. 4*a* is a cross-sectional diagram of another embodiment of a degradation assembly.

FIG. 4*a* discloses an additional compressive element 306, which may also be an annular elastic element. The additional compressive element may be disposed substantially within the stationary portion 203 adjacent the first compressive element, which is within the rotary portion. It is believed that the interaction between these two elements 208 may generate sufficient friction to prevent free rotation.

Figure 4B:
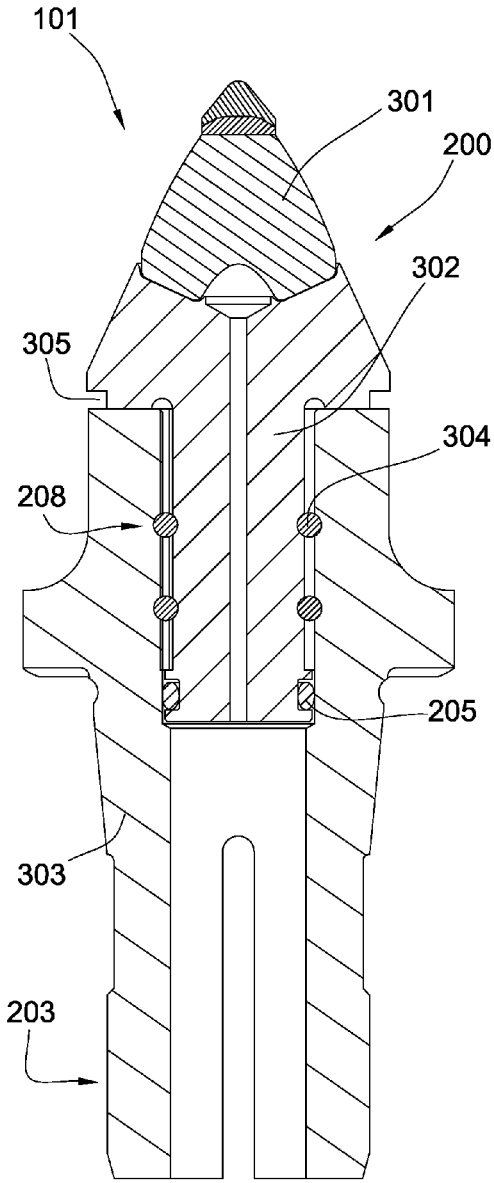
FIG. 4*b* is a cross-sectional diagram of another embodiment of a degradation assembly.

FIG. 4*b* discloses a degradation assembly 101 with a rotary portion 200 comprising an integral shank 302. The stationary portion 203 comprises a holder 303 with a bore adapted to rotational support the integral shank. A compressible element 208 in the form of at least one rubber ball 304 is disposed intermediate the shank 302 and the holder 303. The compressible element may be a elastic ball, wedge, strip, block, square, blob, or combinations thereof. The assembly may also comprise an o-ring 205 disposed intermediate the shank 302 and the holder 303. The o-ring may function as a sealing element to retain lubricant within the assembly. It is believed that the at least one rubber ball 304 may substantially prevent the rotation. The assembly 101 may also comprises a puller attachment 305 disposed on the bolster 301. The puller attachment may be used to remove the rotary portion 200 of the assembly from the holder 303.

Figure 5A:
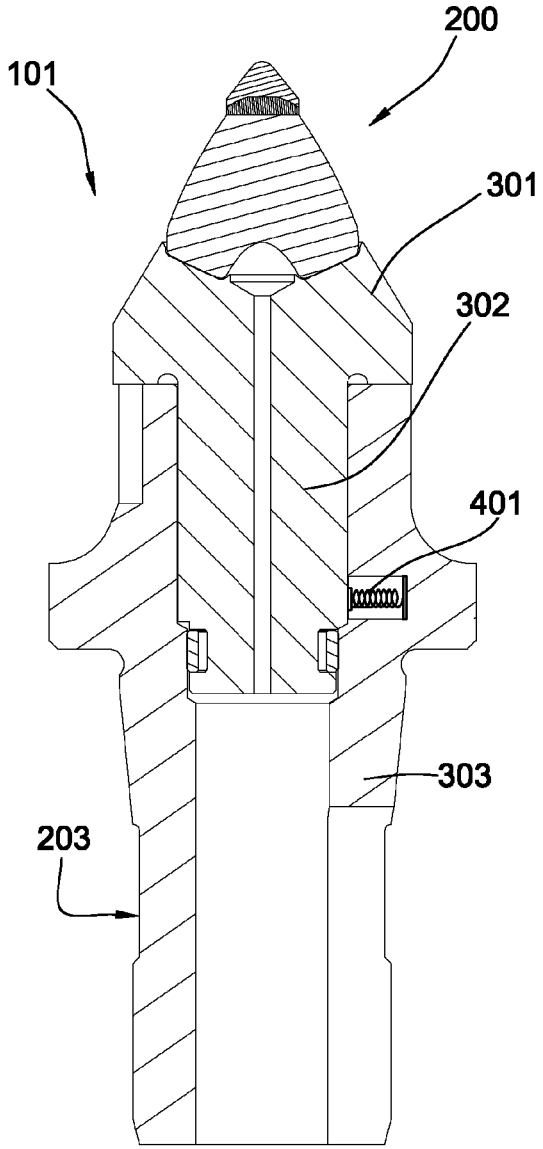
FIG. 5*a* is a cross-sectional diagram of another embodiment of a degradation assembly.

FIG. 5*a* discloses a compression spring 401 is disposed within the holder 303 such that a portion of the spring 401 engages the integral shank 302. It is believed that the compression spring 401 may put enough pressure on the shank 302 to prevent free rotation of the rotary portion 200.

Figure 5B:
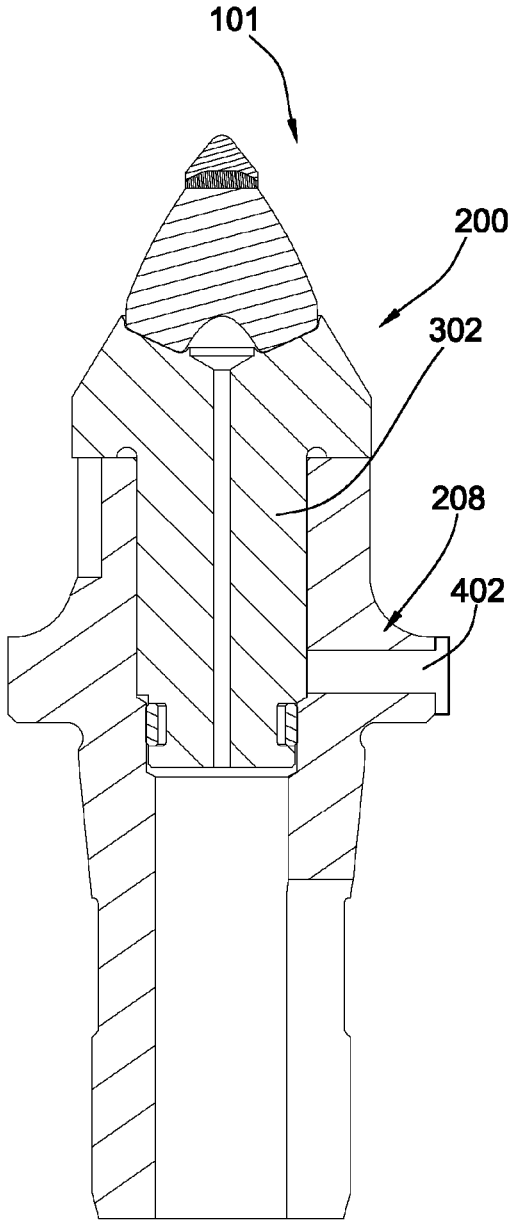
FIG. 5*b* is a cross-sectional diagram of another embodiment of a degradation assembly.

FIG. 5*b* discloses a press fit pin 402 as a compressible element 208. It is believed that the press fit pin 402 is adjusted to put enough pressure on the shank 302 of the rotary portion 200 to prevent free rotation.

Figure 6A:
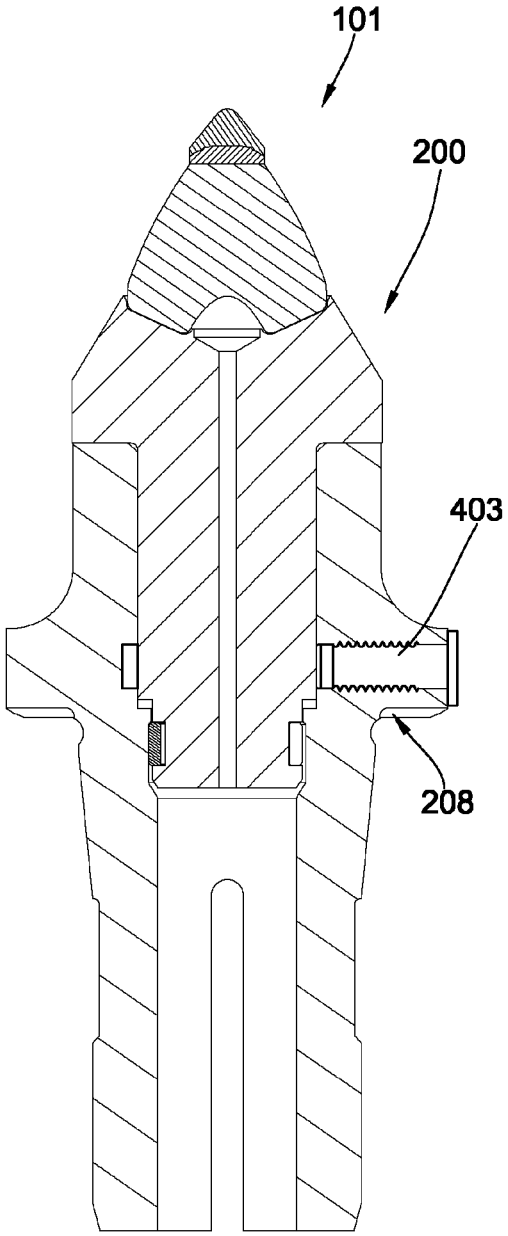
FIG. 6*a* is a cross-sectional diagram of another embodiment of a degradation assembly.

FIG. 6*a* discloses a set screw 403 adapted to energize a compressible element 208.

Figure 6B:
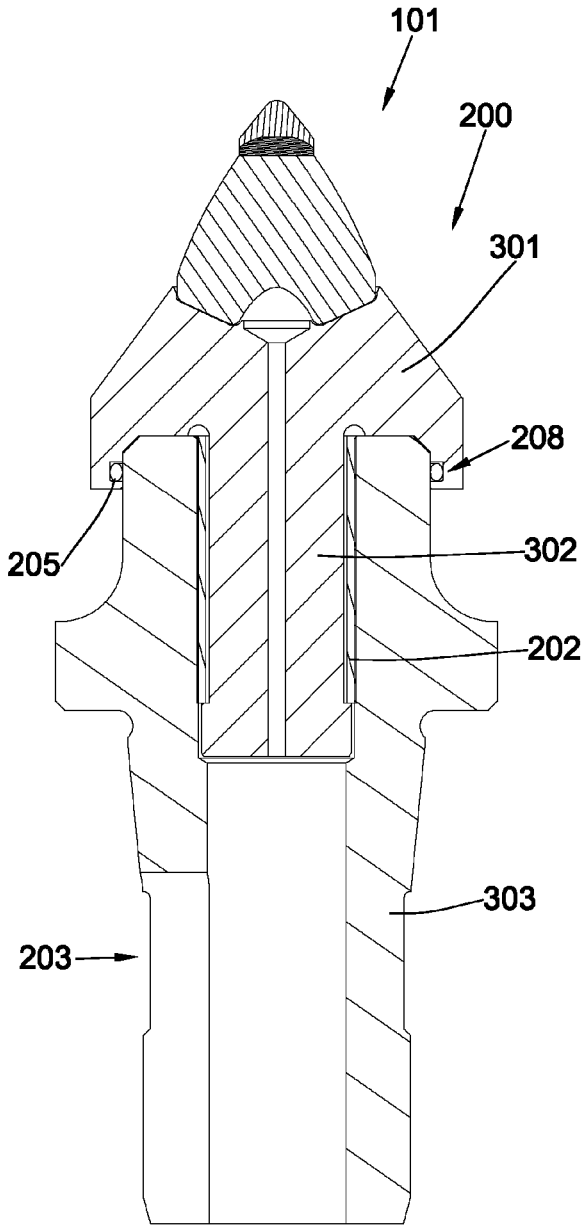
FIG. 6*b* is a cross-sectional diagram of another embodiment of a degradation assembly.

FIG. 6*b* discloses an outer edge of the rotary portion with an integral shank than wraps around a portion of the holder 303. A compressible element 208 in the form of a compressed o-ring 205 is disposed there between. The assembly may also comprise a snap ring 202 disposed intermediate the shank 302 and the holder 303. The snap ring 202 may prevent the rotary portion 200 from separating from the stationary portion 203.

Figure 7:
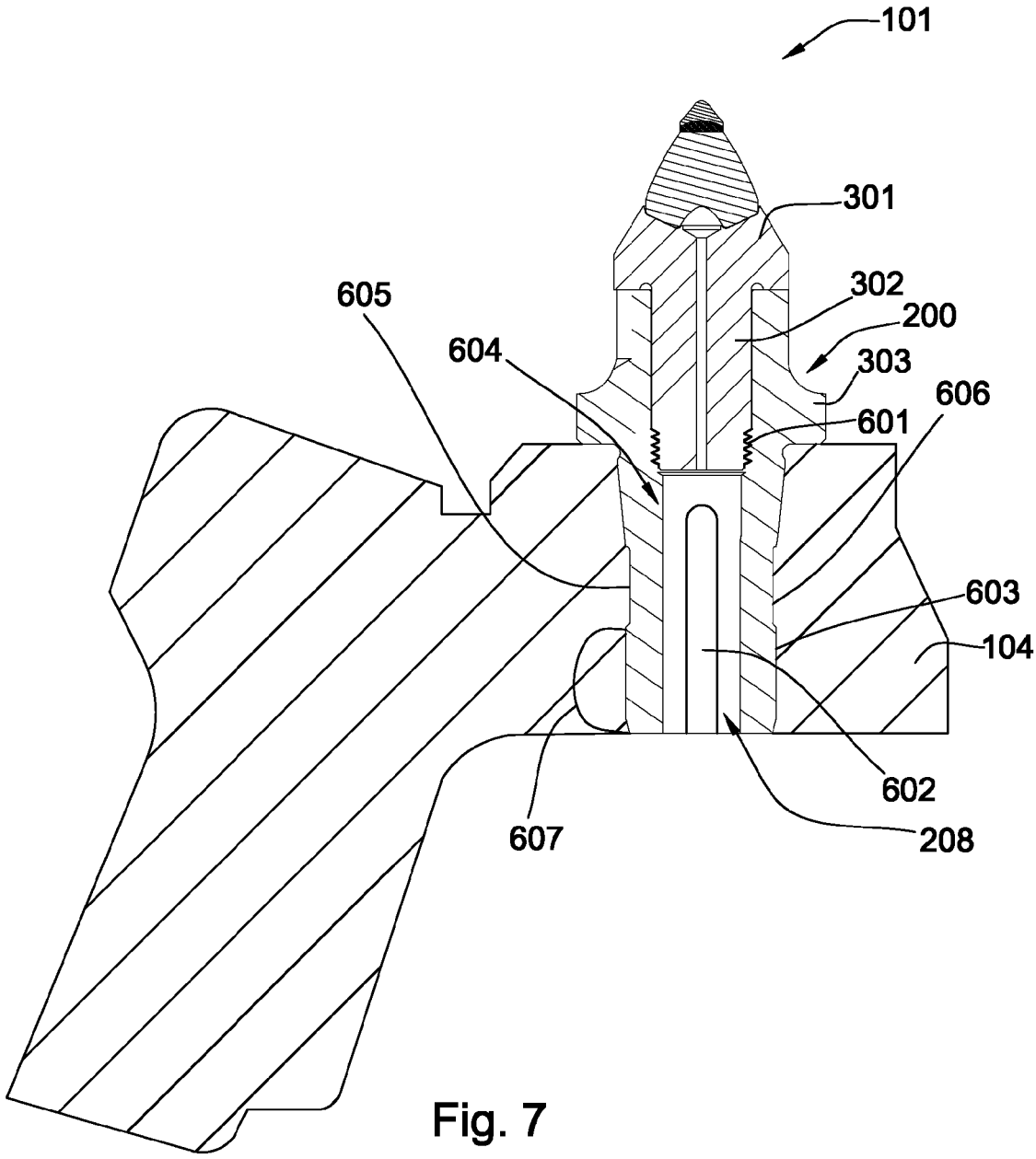
FIG. 7 is a cross-sectional diagram of another embodiment of a degradation assembly.

FIG. 7 discloses a degradation assembly 101 disposed within a holder 303 and a block 104. The rotary portion 200 comprises a bolster 301, a shank 302, and a holder 303. The bolster 301 and the shank 302 are affixed to each other. The shank 302 is in mechanical communication with the holder 303 through a threadform 601. The block 104 comprises a bore 604 with a neck 605 where the bore 604 narrows. The holder 303 may comprise a groove 606 adapted to receive the neck 605 of the bore 604 and a compressible element 208 in the form of at least one slot 602. It is believed that the at least one slot 602 may allow the holder 303 to temporarily compress to allow the holder 303 to squeeze past the neck 605 within the bore 604 of the block 104 until the neck 605 is seated within the groove 606. After the neck 605 has been seated in the groove 606 a portion 607 of the holder 303 comprising the slot 602 may occupy a portion of the bore 604 that is smaller than the natural circumference of the portion 607 of the holder 303. This may cause the portion 607 of the holder 303 to exert an outward force onto the inner wall 603 of the holder 303. It is believed that the force exerted by the portion 607 of the holder 303 onto the inner wall 603 of the bore 604 may prevent the assembly 101 from freely rotating but allow for manual rotation of the assembly 101.

Figure 8A:
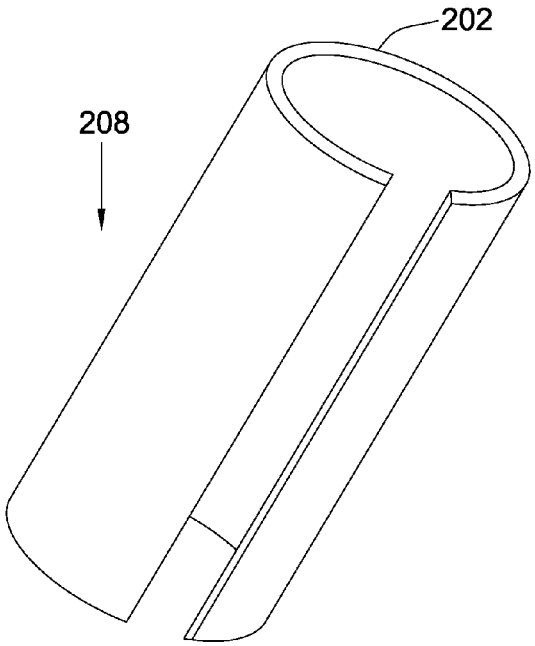
FIG. 8*a* is a perspective view of an embodiment of a snap ring.
Figure 8B:
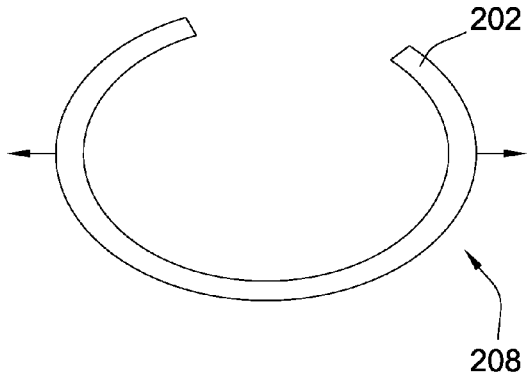
FIG. 8*b* is a top view of an embodiment of a snap ring.

FIGS. 8*a*-8*d* disclose different embodiment of snap rings 202 that may be used as compressible elements 208 to prevent free rotation of an assembly 101 while still allowing for manual rotation. FIGS. 8*a* and 8*b* disclose a snap ring 202 with an oval shape. When the snap ring is disposed intermediate the shank and holder the oval shape is forced into a circular shape causing a portion of the snap ring 202 to collapse onto the shank and holder preventing the free rotation.

Figure 8C:
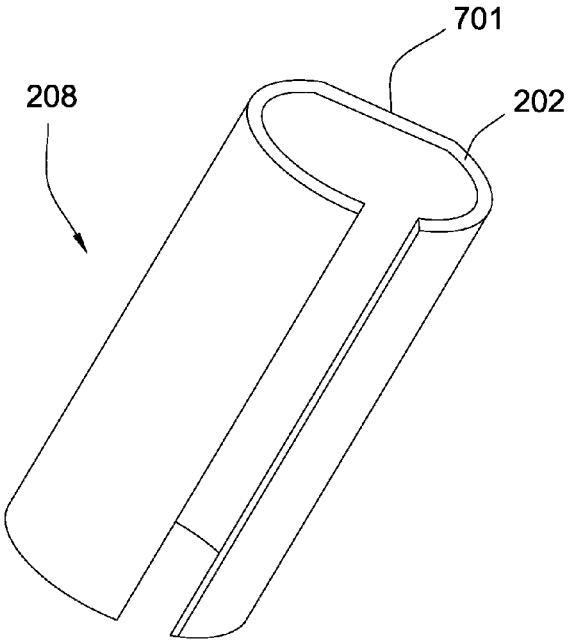
FIG. 8*c* is a perspective view of another embodiment of a snap ring.
Figure 8D:
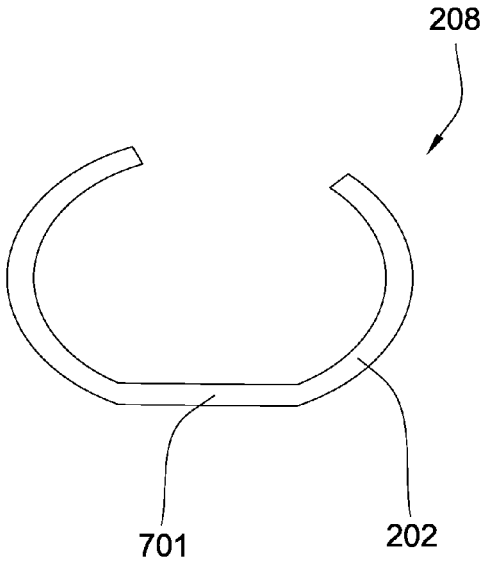
FIG. 8*d* is a top view of another embodiment of a snap ring.

FIGS. 8*c* and 8*d* disclose a snap ring 202 with at least a flat side 701. The flat side 701 may also prevent free rotation by collapsing on both the shank and holder.

Figures 9A, 9B:
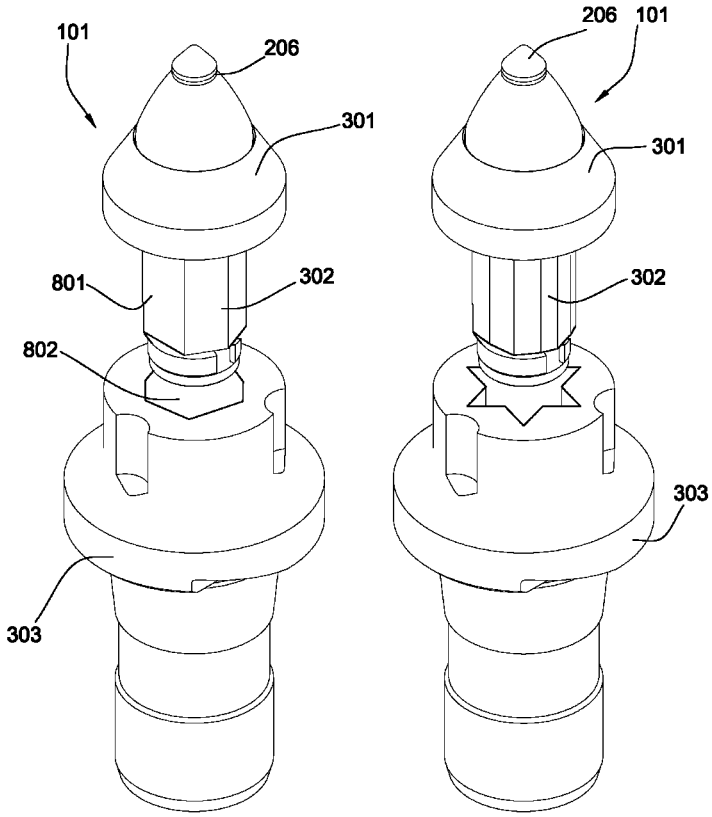
FIG. 9*a* is a cross-sectional diagram of another embodiment of a degradation assembly.
FIG. 9*b* is a cross-sectional diagram of another embodiment of a degradation assembly.

FIGS. 9*a* and 9*b* disclose rotationally indexible degradation assemblies 101. The assembly comprises a holder 303 with a bore 802. The shank 302 comprises longitudinal surfaces 801 complementary to those formed in the bore. FIG. 8*a* discloses a the shank 302 with a hexagonal shape. The bore 802 in the holder 303 comprises a corresponding hexagonal shape of substantially the same proportions as the shank 302. The shank 302 is adapted to be inserted into the bore 802 of the holder 303 in six different orientations due to the hexagonal shape of the shank 302. Each of the different positions may orient a different azimuth of the tip 206 towards a working surface during operation. As one indexed location begins to wear the tip 206 the assembly 101 may be rotated to distribute the wear of the tip 206 to at another azimuth.

FIG. 9*b* discloses a shank 302 and bore 802 of the holder 303 forming a star shape. This shape would allow for multiple azimuthal positions of the conical diamond tip 206.

Figure 10A:
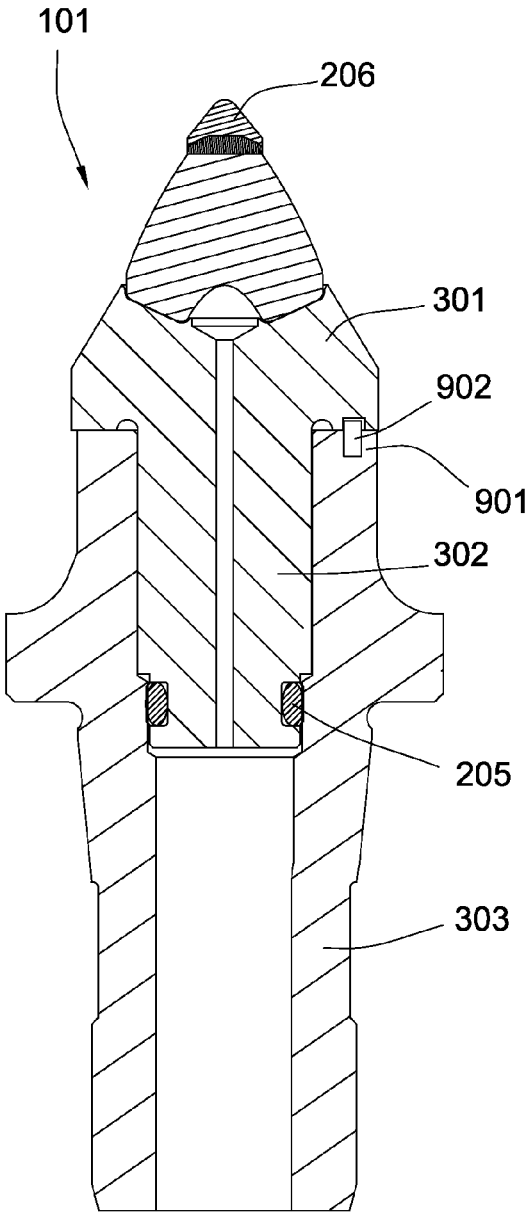
FIG. 10*a* is a cross-sectional diagram of another embodiment of a degradation assembly.
Figure 10B:
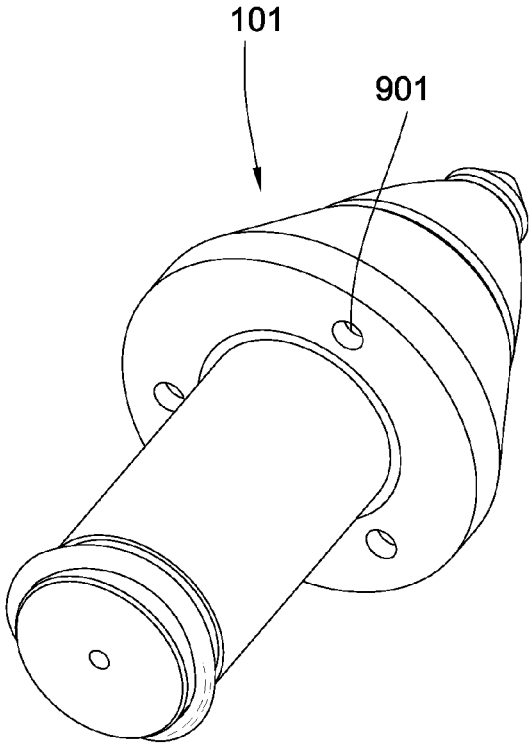
FIG. 10*b* is a perspective view of a diagram of another embodiment of a degradation assembly.

FIGS. 10*a* and 10*b* disclose a rotationally indexible degradation assembly 101. A bolster 301 is intermediate a conical diamond tip 206 and a shank 302. An o-ring 205 may be disposed around the shank 302. The assembly may be disposed within a holder 303. The side of the bolster 301 opposite the conical diamond tip 206 may comprise circumferentially equally spaced holes 901. These holes 901 may be adapted to receive interlocking elements 902. The holder 303 may comprise corresponding holes 901 adapted to receive interlocking elements 902. This embodiment may be used in degradation operations until the conical diamond tip 206 begins to show uneven wear at which time the rotary assembly may be detached from the holder 303 by pulling the holder 303 and the bolster 301 away from each other causing the press fit pins 902 to come out of their holes 901. The bolster may then be rotated until another set of holes 901 align, the interlocking elements 902 are reinserted, and then the bolster 301 may be pressed onto the holder 303. In some embodiments, the interlocking elements are integral to with the stationary or rotary portions of the assembly.

Figure 11A:
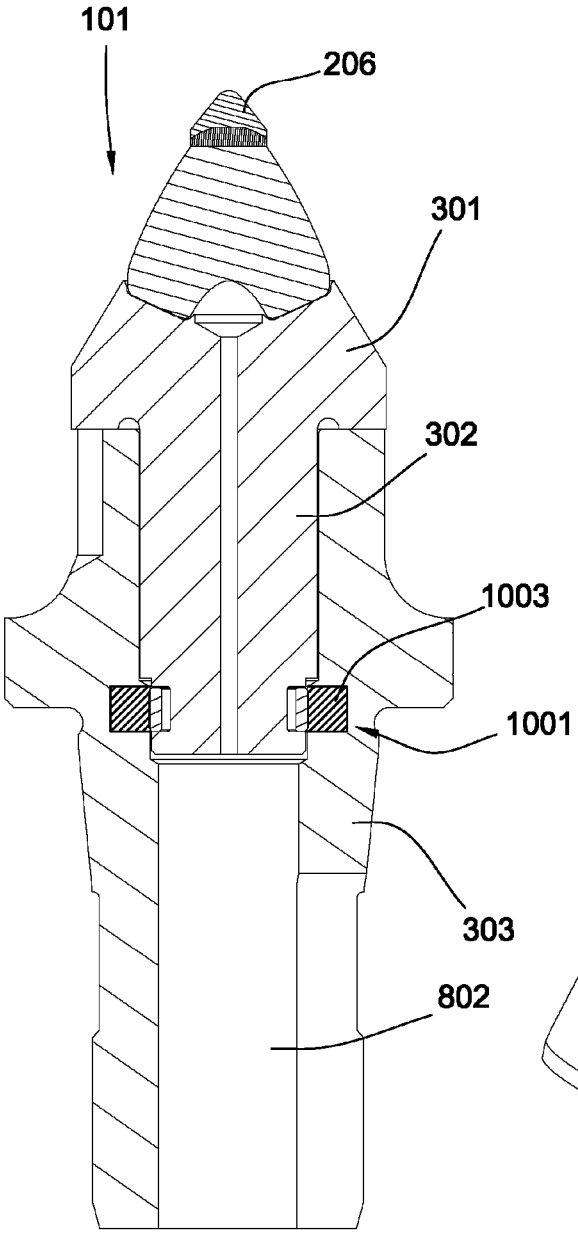
FIG. 11*a* is a cross-sectional diagram of another embodiment of a degradation assembly.
Figure 11B:
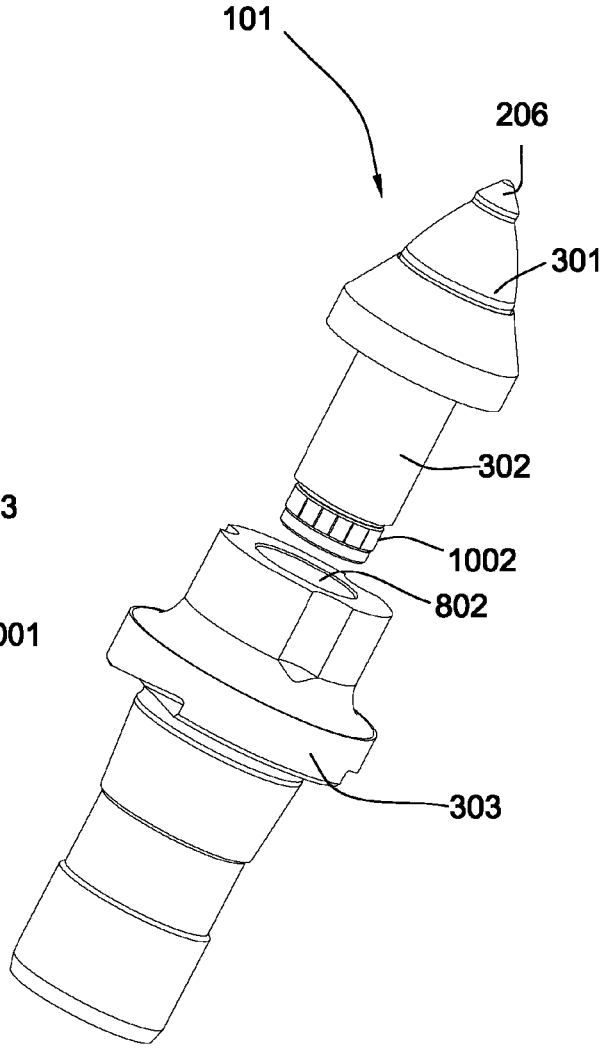
FIG. 11*b* is a perspective view of a diagram of another embodiment of a degradation assembly.

FIGS. 11*a* and 11*b* discloses a racketed cam system 1001 with a set of indexible teeth 1002 disposed around the shank 302. The holder 303 may comprise a tab 1003 adapted to interface with the indexible teeth 1002 on the shank 302. The tab 1003 and the teeth 1002 may interact in such a way that the tab only allows for the teeth 1003 to rotate in a single direction. The tab 1003 may also interfere with the single direction of rotation enough as to prevent free rotation of the assembly 101 while in use.

Figure 12A:
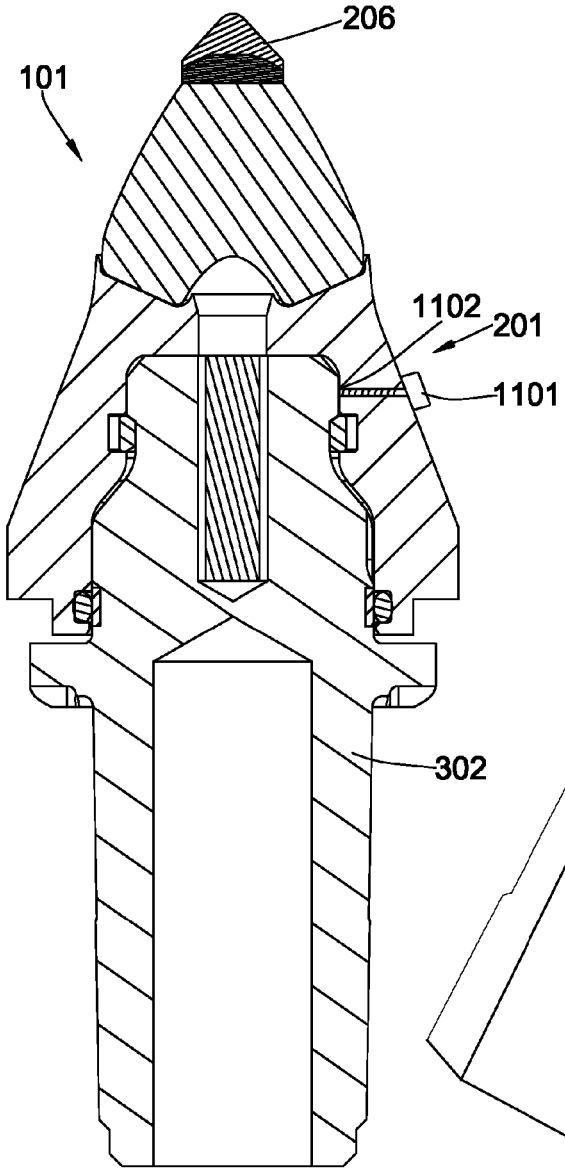
FIG. 12*a* is a cross-sectional diagram of another embodiment of a degradation assembly.

FIG. 12*a* discloses a rotary portion that comprises the conical diamond tip 206 and a shield 201. The stationary portion of the assembly may comprise the shank 302. The shank 302 may comprises equally circumferentially spaced flat surfaces 1102 adapted to receive a set screw 1101. As a conical diamond tip 206 begins to wear the set screw 1102 may be loosened, the shield 201 rotated, and the screw 1102 reset.

Figure 12B:
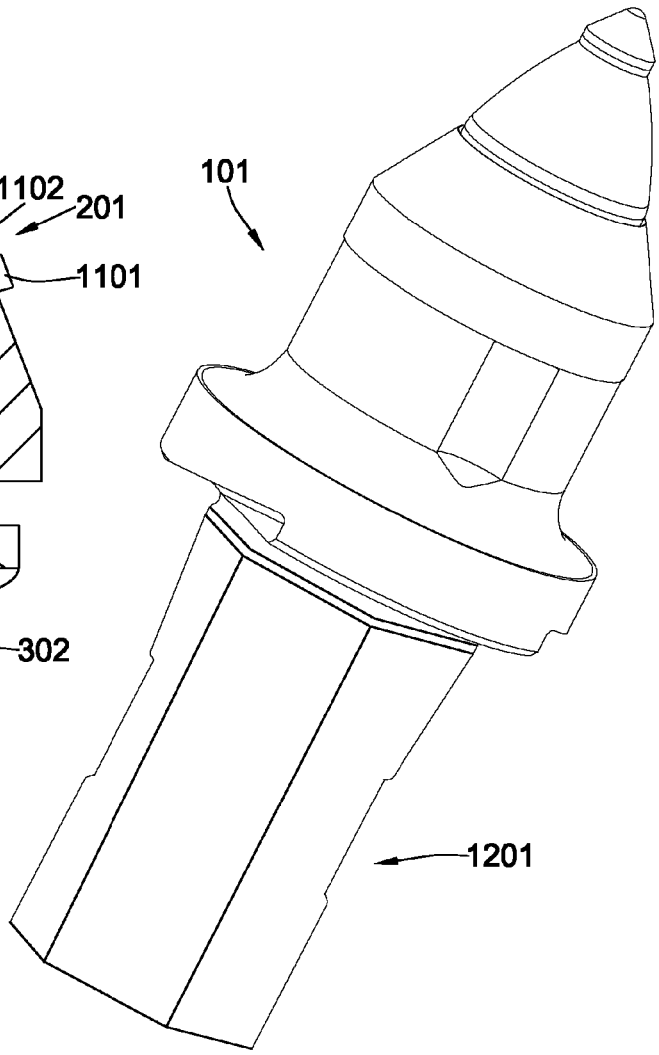
FIG. 12*b* is a cross-sectional diagram of another embodiment of a degradation assembly.

FIG. 12*b* discloses an indexible holder 1201 that comprises axial flats. In this embodiment, the holder comprises a hexagonal shape. When the assembly 101 begins to show uneven wear the holder 1201 may be removed from a block, rotated, and then reinserted.

Figure 13:
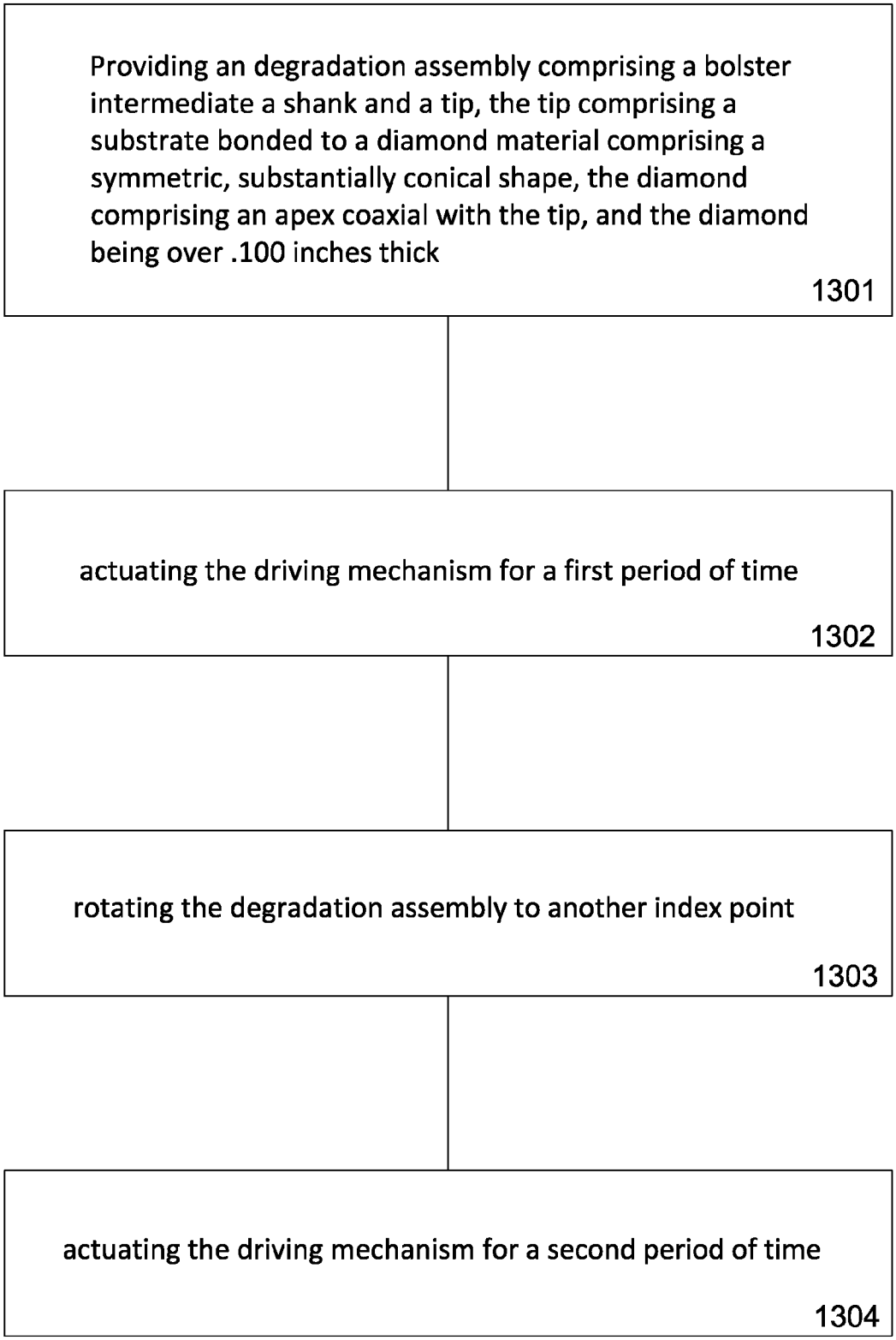
FIG. 13 is a flow chart of an embodiment of a method for manually rotating a degradation assembly.

FIG. 13 is a flow chart of a method for rotating a degradation assembly to another index point to lengthen the life of the assembly. The steps include providing an degradation assembly comprising a bolster intermediate a shank and a tip, the tip comprising a substrate bonded to a diamond material comprising a substantially conical shape, the diamond comprising an apex coaxial with the tip, and the diamond being over 0.100 inches thick 1301. The assembly may then be put into use by actuating the driving mechanism for a first period of time 1302. Once the assembly shows enough uneven wear, the next step includes stopping the driving mechanism and rotating the degradation assembly to another index point 1303. The degradation process is restarted by actuating the driving mechanism for a second period of time 1304.

Whereas the present invention has been described in particular relation to the drawings attached hereto, it should be understood that other and further modifications apart from those shown or suggested herein, may be made within the scope and spirit of the present invention.

What is claimed is:

1. A tool assembly, comprising:

a bolster intermediate a shank and a tip;

the tip comprising a substrate bonded to a diamond material comprising a symmetric, substantially conical shape;

the diamond comprising an apex coaxial with the tip, and the diamond being over 0.100 inches thick along the central axis of the tip;

the shank being inserted into a holder or block attached to a driving mechanism; and the assembly comprises a mechanical indexing arrangement;

wherein the tip comprises a definite number of azimuthal positions determined by the mechanical indexing arrangement, each position orienting a different azimuth of the tip such that the different azimuth impacts first during an operation.

2. The assembly of claim 1, wherein the shank comprises substantially symmetric longitudinal flat surfaces.

3. The assembly of claim 2, wherein the shank axially comprises a hexagonal shape.

4. The assembly of claim 2, wherein the shank axially comprises a star shape.

5. The assembly of claim 1, wherein the shank comprises an o-ring.

6. The assembly of claim 1, wherein the shank comprises a spring clip.

7. The assembly of claim 1, wherein the bolster comprises a puller attachment.

8. The assembly of claim 1, wherein the bolster is in communication with the driving mechanism through at least one press fit pin.

9. The assembly of claim 1, wherein the shank comprises at least one catch.

10. The assembly of claim 1, wherein the indexing arrangement comprises an indexible holder.

11. The assembly of claim 10, wherein the indexible holder comprises a substantially, axially symmetric geometry.

12. The assembly of claim 1, wherein the shank is in communication with the holder through a thread form.

13. The assembly of claim 1, wherein the holder comprises a spring loaded catch.

14. The assembly of claim 1, wherein the tip is rotationally isolated from the shank.

15. The assembly of claim 1, wherein the arrangement comprises a racketed cam associated with the holder.

* * * * *